US009422727B2

(12) United States Patent
Sjoberg et al.

(10) Patent No.: US 9,422,727 B2
(45) Date of Patent: Aug. 23, 2016

(54) PANEL JOINT AND SEAL

(75) Inventors: Ake Sjoberg, Lund (SE); Hakan Wernersson, Lund (SE); Krister Hansson, Trelleborg (SE); Magnus Nilsson, Vellinge (SE); Nils-Erik Engstrom, Trelleborg (SE); Sven Kornfalt, Malmo (SE)

(73) Assignee: PERGO (EUROPE) AB, Trelleborg (SE)

( * ) Notice: Subject to any disclaimer, the term of this patent is extended or adjusted under 35 U.S.C. 154(b) by 0 days.

(21) Appl. No.: 13/620,136

(22) Filed: Sep. 14, 2012

(65) Prior Publication Data

US 2013/0045043 A1 Feb. 21, 2013

Related U.S. Application Data

(63) Continuation of application No. 13/275,002, filed on Oct. 17, 2011, now Pat. No. 8,341,916, which is a continuation of application No. 10/793,944, filed on Mar. 8, 2004, now Pat. No. 8,037,657.

(30) Foreign Application Priority Data

Mar. 11, 2003 (SE) ..... 0300642

(51) Int. Cl.
*F16B 5/00* (2006.01)
*E04F 15/02* (2006.01)

(52) U.S. Cl.
CPC ..... *E04F 15/02005* (2013.01); *E04F 15/02* (2013.01); *E04F 2201/0115* (2013.01);
(Continued)

(58) Field of Classification Search
CPC ..... E04F 15/02005; E04F 15/02; E04F 2201/0153; E04F 2201/03; E04F 2201/0138; E04F 2201/026; E04F 2201/07; E04F 2201/0115; Y10T 403/472; Y10T 428/24777
USPC ..... 52/592.1, 592.2, 592.4, 591.3, 591.1, 52/282.1, 581; 428/192; 156/304.5
See application file for complete search history.

(56) References Cited

U.S. PATENT DOCUMENTS 213,740 A * 4/1879 Conner ..... 52/503
1,723,306 A * 8/1929 Sipe ..... 52/396.04
(Continued)

FOREIGN PATENT DOCUMENTS

WO WO 00/47841 8/2000
WO WO 00/63510 * 10/2000 ..... E04F 15/04
(Continued)

OTHER PUBLICATIONS

Non-Final Office Action for U.S. Appl. No. 13/275,002 dated Dec. 13, 2011.
(Continued)

*Primary Examiner* — Brent W Herring
(74) *Attorney, Agent, or Firm* — Jenkins, Wilson, Taylor & Hunt, P.A.

(57) ABSTRACT

A joint for panels, the panels comprising a core, a decorative upper surface and edges provided with joining means for positioning the panels towards one another. Predetermined portions of the edges are provided with a layer of polymer. The panels are joined to one another by use of the joining means where the polymer forms a seal in the joint preventing penetration of water into the joint wherein a highly water resistant unit of a plurality of panels is formed.

24 Claims, 3 Drawing Sheets

(52) U.S. Cl.
CPC . *E04F2201/0138* (2013.01); *E04F 2201/0153* (2013.01); *E04F 2201/026* (2013.01); *E04F 2201/03* (2013.01); *E04F 2201/07* (2013.01); *Y10T 403/472* (2015.01); *Y10T 428/24777* (2015.01)

(56) References Cited

U.S. PATENT DOCUMENTS

| | | | | |
|---|---|---|---|---|
| 2,430,200 | A * | 11/1947 | Wilson | 52/588.1 |
| 2,495,862 | A * | 1/1950 | Osborn | 52/580 |
| 3,158,586 | A * | 11/1964 | Krause | 523/466 |
| 3,768,846 | A * | 10/1973 | Hensley et al. | 52/127.5 |
| 3,813,368 | A * | 5/1974 | Villa | C08G 75/14 525/437 |
| 3,950,280 | A | 4/1976 | Singleton | |
| 4,037,377 | A * | 7/1977 | Howell et al. | 52/309.9 |
| 4,426,820 | A * | 1/1984 | Terbrack et al. | 52/590.1 |
| 4,599,841 | A | 7/1986 | Haid | |
| 4,644,719 | A | 2/1987 | Salazar | |
| 4,769,963 | A * | 9/1988 | Meyerson | 52/309.9 |
| 4,822,655 | A * | 4/1989 | Foster | 428/41.3 |
| 5,274,979 | A * | 1/1994 | Tsai | 52/588.1 |
| 5,295,341 | A * | 3/1994 | Kajiwara | 52/586.2 |
| 5,338,574 | A * | 8/1994 | O'Neil et al. | 427/387 |
| 5,349,796 | A * | 9/1994 | Meyerson | 52/309.11 |
| 5,394,672 | A * | 3/1995 | Seem | 52/794.1 |
| 5,502,939 | A * | 4/1996 | Zadok et al. | 52/309.9 |
| 5,797,237 | A * | 8/1998 | Finkell, Jr. | 52/589.1 |
| 5,843,552 | A | 12/1998 | Karrfalt | |
| 5,939,203 | A | 8/1999 | Kappock et al. | |
| 6,006,486 | A * | 12/1999 | Moriau et al. | 52/589.1 |
| 6,101,778 | A * | 8/2000 | Mårtensson | 52/582.1 |
| 6,314,701 | B1 | 11/2001 | Meyerson | |
| 6,345,481 | B1 * | 2/2002 | Nelson | 52/592.2 |
| 6,421,970 | B1 | 7/2002 | Martensson et al. | |
| 6,449,918 | B1 | 9/2002 | Nelson | |
| 6,505,452 | B1 | 1/2003 | Hannig et al. | |
| 6,536,178 | B1 * | 3/2003 | Pålsson et al. | 52/589.1 |
| 6,588,166 | B2 * | 7/2003 | Martensson et al. | 52/578 |
| 6,591,568 | B1 | 7/2003 | Palsson | |
| 6,606,834 | B2 * | 8/2003 | Martensson et al. | 52/578 |
| 6,647,690 | B1 * | 11/2003 | Martensson | 52/601 |
| 6,672,030 | B2 * | 1/2004 | Schulte | 52/747.1 |
| 6,766,622 | B1 | 7/2004 | Thiers | |
| 6,772,568 | B2 * | 8/2004 | Thiers et al. | 52/592.1 |
| 6,830,799 | B1 * | 12/2004 | Duffin et al. | 428/131 |
| 6,854,235 | B2 * | 2/2005 | Martensson | 52/601 |
| 6,874,292 | B2 | 4/2005 | Moriau et al. | |
| 6,922,965 | B2 * | 8/2005 | Rosenthal et al. | 52/592.1 |
| 6,931,811 | B2 | 8/2005 | Thiers | |
| 6,972,888 | B2 | 12/2005 | Poll et al. | |
| 7,121,058 | B2 | 10/2006 | Palsson et al. | |
| 7,131,242 | B2 * | 11/2006 | Martensson et al. | 52/591.3 |
| 7,188,456 | B2 * | 3/2007 | Knauseder | 52/592.1 |
| 7,251,916 | B2 * | 8/2007 | Konzelmann et al. | 52/592.1 |
| 7,332,053 | B2 | 2/2008 | Palsson et al. | |
| 7,516,588 | B2 | 4/2009 | Pervan | |
| 7,634,884 | B2 * | 12/2009 | Pervan et al. | 52/582.1 |
| 7,802,415 | B2 * | 9/2010 | Pervan et al. | 52/745.19 |
| 7,841,144 | B2 * | 11/2010 | Pervan | 52/395 |
| 7,841,145 | B2 * | 11/2010 | Pervan et al. | 52/395 |
| 7,845,140 | B2 * | 12/2010 | Pervan | 52/747.1 |
| 7,886,497 | B2 * | 2/2011 | Pervan | 52/588.1 |
| 7,908,816 | B2 * | 3/2011 | Grafenauer et al. | 52/586.2 |
| 8,028,486 | B2 * | 10/2011 | Pervan et al. | 52/588.1 |
| 8,037,657 | B2 * | 10/2011 | Sjoberg et al. | 52/592.1 |
| 8,132,384 | B2 * | 3/2012 | Hannig | 52/582.1 |
| 8,245,478 | B2 * | 8/2012 | Bergelin et al. | 52/592.1 |
| 8,293,058 | B2 * | 10/2012 | Pervan et al. | 156/265 |
| 8,341,916 | B2 | 1/2013 | Sjoberg | |
| 8,544,233 | B2 * | 10/2013 | Palsson et al. | 52/588.1 |
| 8,615,953 | B2 * | 12/2013 | Cappelle | 52/588.1 |
| 8,631,621 | B2 * | 1/2014 | Hannig | 52/582.1 |
| 8,631,625 | B2 * | 1/2014 | Thiers et al. | 52/591.1 |
| 8,689,513 | B2 * | 4/2014 | Windmoller | E04F 15/02 52/588.1 |
| 8,833,029 | B2 * | 9/2014 | Grafenauer | 52/592.1 |
| 8,857,127 | B2 * | 10/2014 | Windmoller | E04F 15/02038 52/309.16 |
| 2002/0007909 | A1 | 1/2002 | Mott et al. | |
| 2002/0020127 | A1 * | 2/2002 | Thiers et al. | 52/403.1 |
| 2002/0046526 | A1 * | 4/2002 | Knauseder | 52/581 |
| 2002/0059765 | A1 * | 5/2002 | Nogueira et al. | 52/403.1 |
| 2002/0170257 | A1 | 11/2002 | McLain et al. | |
| 2002/0178680 | A1 * | 12/2002 | Martensson et al. | 52/578 |
| 2002/0178681 | A1 * | 12/2002 | Zancai et al. | 52/592.1 |
| 2002/0189183 | A1 | 12/2002 | Ricciardelli | |
| 2003/0024199 | A1 * | 2/2003 | Pervan et al. | 52/589.1 |
| 2003/0094230 | A1 | 5/2003 | Sjoberg | |
| 2003/0141004 | A1 | 7/2003 | Palmblad et al. | |
| 2003/0180091 | A1 * | 9/2003 | Stridsman | 404/41 |
| 2004/0031225 | A1 * | 2/2004 | Fowler | 52/578 |
| 2004/0031226 | A1 | 2/2004 | Miller | |
| 2004/0031227 | A1 * | 2/2004 | Knauseder | 52/592.1 |
| 2004/0035079 | A1 | 2/2004 | Evjen | |
| 2005/0016107 | A1 * | 1/2005 | Rosenthal et al. | 52/578 |
| 2006/0010820 | A1 | 1/2006 | Schwitte et al. | |
| 2007/0119110 | A1 | 5/2007 | Pervan | |
| 2007/0159814 | A1 | 7/2007 | Jacobsson | |
| 2007/0175148 | A1 * | 8/2007 | Bergelin et al. | 52/480 |
| 2012/0034024 | A1 | 2/2012 | Sjoberg | |
| 2012/0222378 | A1 * | 9/2012 | Cappelle et al. | 52/309.1 |
| 2013/0047536 | A1 * | 2/2013 | Pervan | 52/309.1 |
| 2014/0157695 | A1 * | 6/2014 | Windmoller | E04F 15/02038 52/177 |

FOREIGN PATENT DOCUMENTS

| | | |
|---|---|---|
| WO | WO 01/51732 | 7/2001 |
| WO | WO 01/75247 | 10/2001 |
| WO | WO 03/016654 | 2/2003 |

OTHER PUBLICATIONS

Final Office Action for U.S. Appl. No. 13/275,002 dated May 30, 2012.

Notice of Allowance for U.S. Appl. No. 13/275,002 dated Sep. 4, 2012.

* cited by examiner

PANEL JOINT AND SEAL

CROSS-REFERENCE TO RELATED APPLICATIONS

This application is a continuation of and claims priority to U.S. Ser. No. 13/275,002 filed Dec. 17, 2011, which claims priority to U.S. Ser. No. 10/793,944 filed Mar. 8, 2004, which issued as U.S. Pat. No. 8,037,657 on Oct. 18, 2011, which claims priority to Swedish Application No. 0300642 filed Mar. 11, 2003.

The present invention relates to sealing of a joint comprising glued edges. Prefabricated surface elements which at their edges are provided with groove and tenon are well known nowadays. As these are very easy to install, it is possible for the normal handy man to achieve this. Such elements can be constituted of massive wood, fibre board or particle board. These are often provided with a surface layer, such as lacquer or some sort of laminate. The boards are most often installed by gluing them together via their groove and tenon. It is desired to join the separate elements so closely that the joint becomes practically invisible, which increases the moisture resistance radically. The usable life of the installed elements are hereby also increased. It is essential that glue is used excessively in order to achieve a tight joint. Any gaps will make it possible for moisture to penetrate the joint with subsequent swelling of the core material closest to the joint. The glue also have to be used to an amount that it is spill out trough the joint on the decorative side of the surface elements. The superfluous glue will of course have to be wiped off before beginning to set, which is very time consuming.

One way of solving the problem is available on the market for some time now through different types of so-called click or snap-lock floor boards where no glue is to be used. The installation of such floor boards has become much swifter as no glue is required and the locking systems will in most cases provide adequate mechanical strength keeping the floor boards together. The problems with these type of surface elements are that relatively small spills of fluids like water may cause great damage on the installed surface elements as well as sub walls and especially subfloors as the fluid will run through the joints rather rapidly due to the capillary effect. It is, of course, possible to use glue on these snap-lock type of elements as well although the problem with the time consuming cleaning during installation would remain.

It has, through the present invention, been made possible to solve the above mentioned problems so that self sealing surface elements can be achieved. Accordingly the invention relates to a joint for panels, the panels comprising a core, a decorative upper surface and edges provided with joining means for positioning the panels towards one another. Predetermined portions of the edges are provided with a layer of polymer. The panels are joined to one another by use of the joining means where the polymer forms a seal in the joint preventing penetration of water into the joint wherein a highly water resistant unit of a plurality of panels is founed.

The panels are according to one embodiment of the invention provided with male and female edges, the male edges being intended to being joined with the female edges. According to another embodiment of the invention at least two of the edges arranged on opposite sides of the panel are provided with female edges which are joined together by means of a separate profile having two mail edges.

According to one preferred embodiment of the invention predetermined parts of mating surfaces of the male edges and female edges respectively are each provided with the layer of polymer. It is advantageous to coat at least the parts of the edges closest to the upper decorative surface as this will protect the core material from absorbing moisture and spills from above.

It is suitable to choose a polymer for the mating surfaces which migrates and merges to form a unit. There are a number of known polymers which have this property. It is advantageous to use a polymer with good storage stability and which do not dry out or form skin before the installation.

As an example of a polymer which may be used can be mentioned contact glue which normally is of a nitril rubber type. The disadvantage with this polymer system is that it dries out and crystallise rather quickly, and is therefore not the best of choices. It might however be used if reactivated in connection to the assembly by adding a solvent or by heating the joint.

Another example of a polymer which is suitable is non-curing thermoplastic sealants like a butyl rubber. One specific example of such a polymer which has shown to be useful is Bostic® Butyl 1124. It is also possible to use polymers like ethyl-vinyl-acetate (EVA) or polymer blends containing EVA.

It is also possible to use natural resins like for example natural bitumen and also different types of oil distillate like technical bitumen.

It is advantageous if the polymer is water repellent.

The invention is described further in connection to enclosed drawing showing different embodiments of the invention whereby;

Figure 4A:
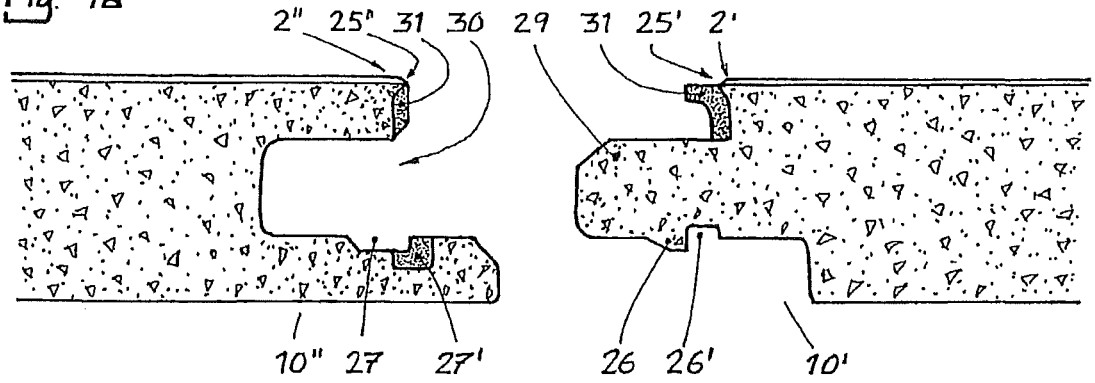
Figure 4B:
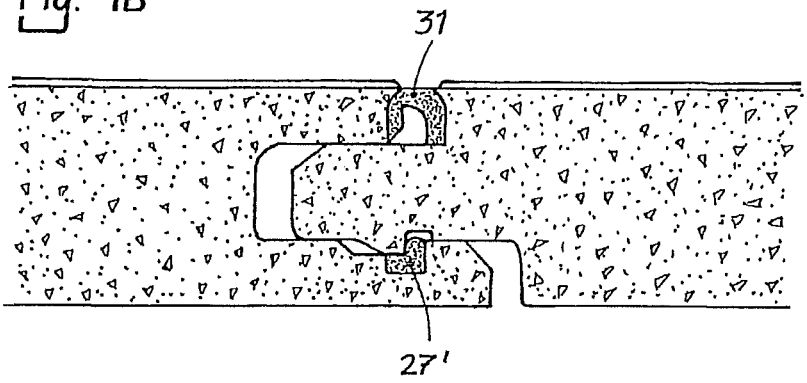
Figure 4C:
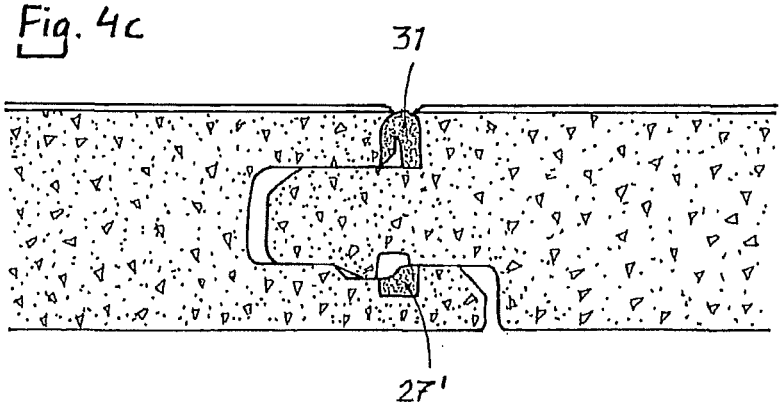

FIG. 4*a*-4*c* shows a special embodiment of adjacent edges of two panels to be joined according to the present invention.

Figure 5:
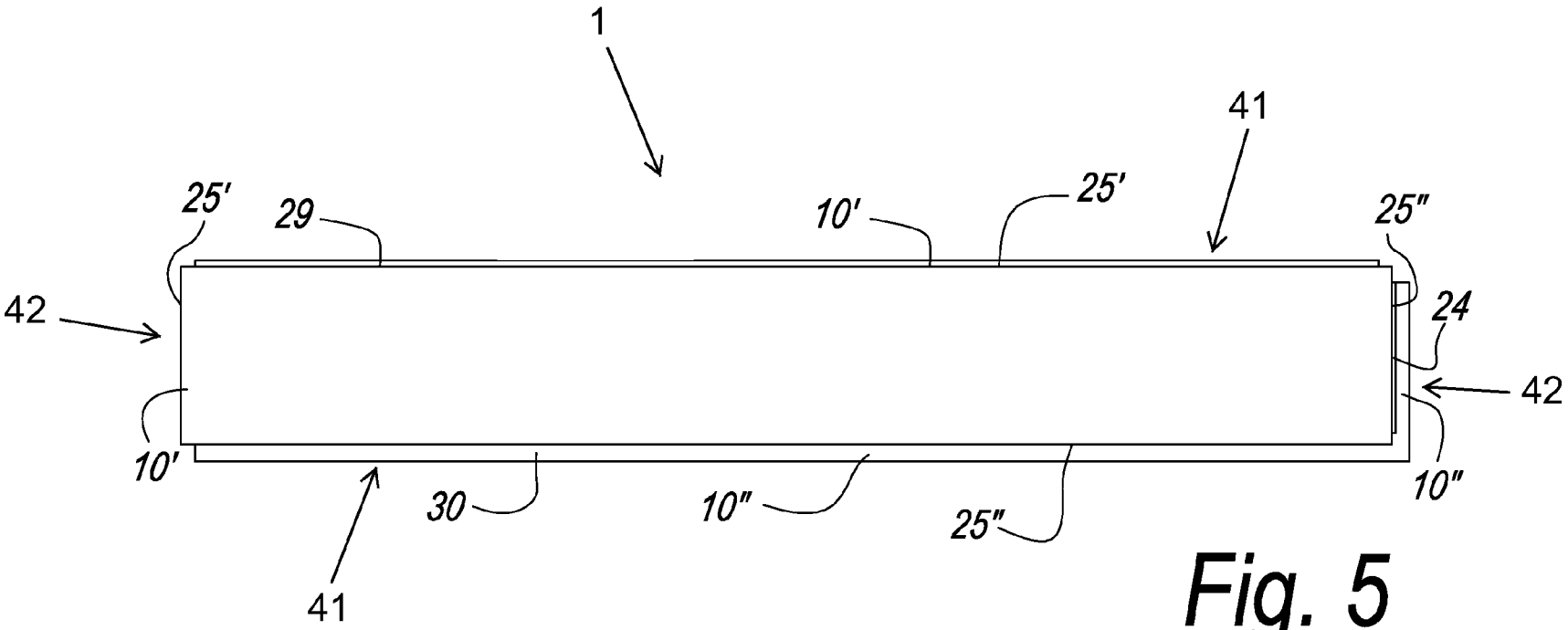

FIG. 5 shows a rectangular panel of the present invention.

Figure 1:
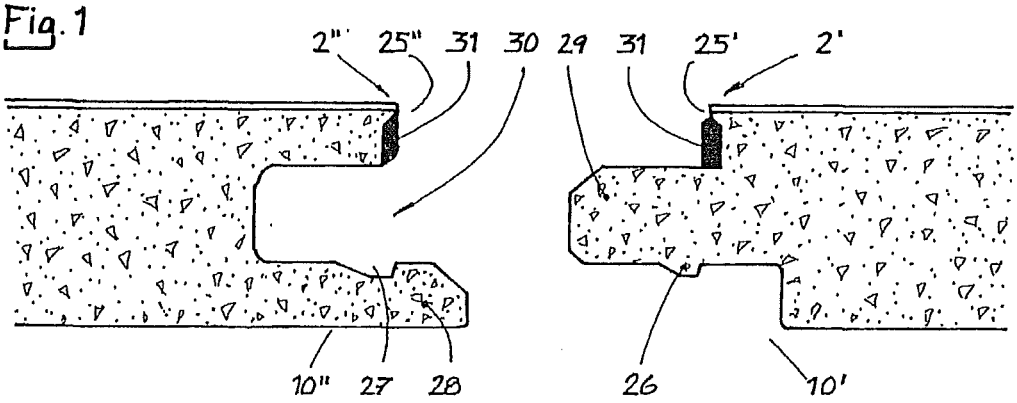
FIG. 1 shows a first embodiment of adjacent edges of two panels to be joined according to the present invention.

FIG. 1 shows, in cross-section, two adjacent edges according to a first embodiment of the invention. The panels 1 are provided with a first assembly joining member 10' on a male edge 2' while a female edge 2" is provided with a second assembly joining member 10". The female edge 2" is arranged on a side opposite to the male edge 2'. The first assembly joining member 10' is provided with a lower snapping web 26 arranged on the lower side of a tongue. The lower snapping web 26 is intended to interact with a recess 27 arranged on a lower cheek 28 arranged on the second assembly joining members 10" so that two joined adjacent panels 1 are locked against each other in a horizontal direction. The lower cheek 28 forms a lower surface of a groove 30 in the female edge 2".

The joint between a male and a female edge 2' and 2" respectively of two joined panels 1 further comprises contact surfaces which are constituted by the lower snapping web 26 and recess 27, the tongue 29 and groove 30 as well as upper male and female mating surfaces 25' and 25" respectively. These upper male and female mating surfaces 25' and 25" respectively are provided with recesses in which a polymer sealer 31 is applied. This polymer is suitably a non-curing thermoplastic elastomeric sealant which will merge over the edge once assembled so that the two separate polymer sealers 31 will fuse over time to form one elastic seal. It is also possible to utilise other thermoplastic elastomers where only one of the upper mating surfaces 25' or 25" respectively are provided with a polymer sealer 31 comprising a plasticiser while the other upper mating surface 25' or 25" respectively is provided with a polymer sealer 31 lacking this plasticiser.

Once the panels are joined and the polymer sealer 31 of the two mating surfaces 25' and 25" respectively, are in contact, the plasticiser will start to migrate and a glue-like effect will be obtained. It is also possible to use an expansion agent in the polymer sealer which will improve the elastic properties of the seal.

The polymer sealer 31 is primarily used for sealing the joint, thereby improving the water and moisture resistance of an installed surface comprising panels according to the invention. The assembly joining members 10' and 10" respectively will give the mechanical strength of the joint.

The joint between two joined panels 1 also comprises cavities which are formed between the surfaces of the assembled joint. These cavities will give room for any loose particles that inevitably will be present in the joint. These particles may otherwise obstruct the installation in different ways, like causing so-called proud edges locally.

Figure 2:
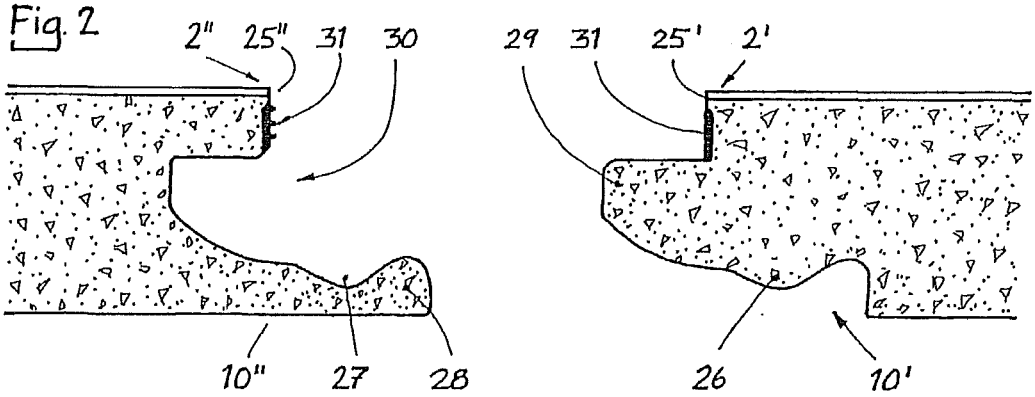
FIG. 2 shows a second embodiment of adjacent edges of two panels to be joined according to the present invention.

FIG. 2 shows, in cross-section, two adjacent edges according to a second embodiment of the invention. The embodiment shows similarities with the embodiment shown in FIG. 1. The panels 1 are provided with a first assembly joining member 10' on a male edge 2' while a female edge 2' is provided with a second assembly joining member 10". The female edge 2" is arranged on a side opposite to the male edge 2'. The first assembly joining member 10' is provided with a lower snapping web 26 arranged on the lower side of a tongue. The lower snapping web 26 is intended to interact with a recess 27 arranged on a lower cheek 28 arranged on the second assembly joining members 10" so that two joined adjacent panels 1 are locked against each other in a horizontal direction. The lower cheek 28 forms a lower surface of a groove 30 in the female edge 2".

The joint between a male and a female edge 2' and 2" respectively of two joined panels 1 further comprises contact surfaces which are constituted by the lower snapping web 26 and recess 27, the tongue 29 and groove 30 as well as upper male and female mating surfaces 25' and 25" respectively. These upper male and female mating surfaces 25'[1] and 25" respectively are provided with recesses in which a polymer sealer 31 is applied. This polymer is suitably a non-curing thermoplastic elastomeric sealant which will merge over the edge once assembled so that the two separate polymer sealers 31 will fuse over time to form one elastic seal. In order to ensure a good initial pressure over the joint between the two polymer sealers 31, at least one of them is provided with a number of narrow, protruding lips 31'. These narrow, protruding lips 31' will make the need of a narrow matching and manufacturing tolerance in respect of the thickness of the two polymer sealers 31 less critical. It will hereby be possible to avoid problems caused by having applied polymer sealers 31 that are too thick. This would otherwise cause problems during installation and could also cause the polymer sealers 31 to being squeezed up on top of the laminate where the abundant polymer sealer 31 is easily removed. Nevertheless, it is desired to avoid this extra operation in the installation process. It is further possible to use an expansion agent in the polymer sealer which will further improve the elastic properties of the seal.

The polymer sealer 31 is primarily used for sealing the joint, thereby improving the water and moisture resistance of an installed surface comprising panels according to the invention. The assembly joining members 10' and 10" respectively will give the mechanical strength of the joint.

The joint between two joined panels 1 also comprises cavities which are formed between the surfaces of the assembled joint.

Figure 3:
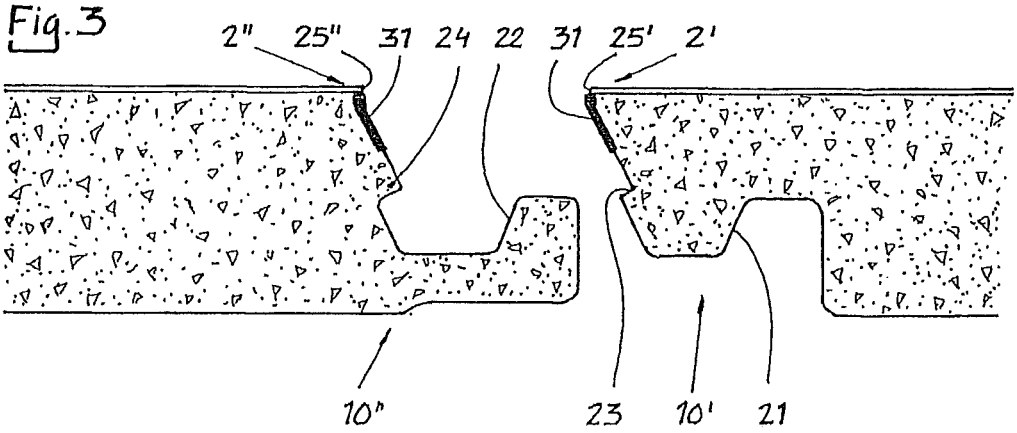
FIG. 3 shows a third embodiment of adjacent edges of two panels to be joined according to the present invention.

FIG. 3 shows, in cross-section, two adjacent edges according to a third embodiment of the invention. The panels 1 are provided with a first vertical assembly joining member 10' on a male edge 2' while a female edge 2" is provided with a second vertical assembly joining member 10". The female edge 2" is arranged on a side opposite to the male edge 2'. The first vertical assembly joining member 10[1] is provided with mainly vertical lower cheek surfaces 21 arranged parallel to the closest edge 2. The lower cheek surfaces 21 are intended to interact with mainly vertical upper cheek surfaces 22 arranged on the second vertical assembly joining members 10" so that two joined adjacent panels 1 are locked against each other in a horizontal direction. The first vertical assembly joining member 10' is moreover provided with a snapping hook 23 while the second vertical assembly joining member 10" is provided with a matching undercut 24, which by being provided with mainly horizontal locking surfaces limits the vertical movement between two joined adjacent panels 1.

The joint between a male and female edge 2' and 2" respectively of two joined panels 1 further comprises contact surfaces which are constituted by the locking surfaces of the under cuts 23 and hooks 24, the mainly vertical upper cheek surfaces 22, lower cheek surfaces 21 as well as upper mating surfaces 25.

The joint between a male and a female edge 2' and 2" respectively of two joined panels 1 further comprises contact surfaces which are constituted by the lower snapping web 26 and recess 27, the tongue 29 and groove 30 as well as upper male and female mating surfaces 25' and 25" respectively. These upper male and female mating surfaces 25' and 25" respectively are provided with recesses in which a polymer sealer 31 is applied. This polymer is suitably a non-curing thermoplastic elastomeric sealant which will merge over the edge once assembled so that the two separate polymer sealers 31 will fuse over time to form one elastic seal. It is also possible to utilise other thermoplastic elastomers where only one of the upper mating surfaces 25' or 25" respectively are provided with a polymer sealer 31 comprising a plasticiser while the other upper mating surface 25' or 25" respectively is provided with a polymer sealer 31 lacking this plasticiser. Once the panels are joined and the polymer sealer 31 of the two mating surfaces 25' and 25" respectively, are in contact, the plasticiser will start to migrate and a glue-like effect will be obtained. As described in connection to FIG. 2 above it is also possible to provide at least one of the two polymer sealers 31 with one or a number of narrow, protruding lips 31' in order to ensure a good initial pressure over the joint between the two polymer sealers 31, These narrow, protruding lips 31' will make the need of a narrow matching and manufacturing tolerance in respect of the thickness of the two polymer sealers 31 less critical. It is further possible to use an expansion agent in the polymer sealer which also will improve the elastic properties of the seal.

The polymer sealer 31 is primarily used for sealing the joint, thereby improving the water and moisture resistance of an installed surface comprising panels according to the invention. The assembly joining members 10' and 10" respectively will give the mechanical strength of the joint.

The joint between two joined panels 1 also comprises cavities which are formed between the surfaces of the assembled joint. These cavities will give room for any loose particles that inevitably will be present in the joint. These particles may otherwise obstruct the installation in different ways, like causing so-called proud edges locally.

It is according to a special embodiment of the invention possible to use one type of joint on two of the edges 2, arranged on opposite sides, while remaining, adjacent edges 2 are provided with a second type of joint. It is accordingly possible to use the joint shown in figure one or two on the long side edges 41 of a rectangular panel 1 (see FIG. 5), while the short side edges 42 are provided with a joint as shown in figure three. It is of course also possible to use the same type of joint on all edges 2 of the panel 1. The panel 1 may of course also have other shapes than being rectangular.

FIGS. 4*a*, 4*b* and 4*c* shows, in cross-section, a special embodiment of the invention. FIG. 4*a* shows two adjacent edges before assembly while FIGS. 4*b* and 4*c* shows the same edges assembled. The embodiment shows similarities with the embodiment shown in FIG. 1. The panels 1, as best viewed in FIG. 4*a*, are provided with a first assembly joining member 10' on a male edge 2' while a female edge 2" is provided with a second assembly joining member 10". The female edge 2' is arranged on a side opposite to the male edge 2'. The first assembly joining member 10' is provided with a lower snapping web 26 arranged on the lower side of a tongue. A web recess 26' is located behind the lower snapping web 26. The lower snapping web 26 is intended to interact with a recess 27 arranged on a lower cheek 28 arranged on the second assembly joining members 10" so that two joined adjacent panels 1 are locked against each other in a horizontal direction. The lower cheek 28 forms a lower surface of a groove 30 in the female edge 2". A flexible insert 27' is located in the recess 27. This flexible insert 27' is located between the recess 27 and the lower snapping web 26 and will allow a limited movement in horizontal direction between the panels. The web recess 26' will leave space for the flexible insert 27' to bulge out when being compressed.

The joint between a male and a female edge 2' and 2" respectively of two joined panels 1 further comprises contact surfaces which are constituted by the lower snapping web 26 and recess 27, the tongue 29 and groove 30 as well as upper male and female mating surfaces 25' and 25" respectively. These upper male and female mating surfaces 25' and 25" respectively are provided with recesses in which a polymer sealer 31 is applied. This polymer, which suitably also is used when manufacturing the flexible insert 27', is suitably a non-curing thermoplastic elastomeric sealant which will merge over the edge once assembled so that the two separate polymer sealers 31 will fuse over time to form one elastic seal. In order to ensure a good initial pressure over the joint between the two polymer sealers 31, at least one of them is provided with a number of narrow, protruding lips 31'. These narrow, protruding lips 31' will make the need of a narrow matching and manufacturing tolerance in respect of the thickness of the two polymer sealers 31 less critical. It will hereby be possible to avoid problems caused by having applied polymer sealers 31 that are too thick. This would otherwise cause problems during installation and could also cause the polymer sealers 31 to being, squeezed up on top of the laminate where the abundant polymer sealer 31 is easily removed. Nevertheless, it is desired to avoid this extra operation in the installation process. It is further possible to use an expansion agent in the polymer sealer which will further improve the elastic properties of the seal.

The polymer sealer 31 is primarily used for sealing the joint, thereby improving the water and moisture resistance of an installed surface comprising panels according to the invention. The assembly joining members 10' and 10" respectively will give the mechanical strength of the joint.

The polymer sealer 31 together with the flexible insert will allow a limited movement between two adjacent panels 1 with a maintained seal protecting from penetration of moisture. The amount of movement allowed is easily adjusted through the dimensions of the recess 27, polymer sealer 31 and flexible insert 27'. It is advantageous to use the invention as described in connection to FIG. 4*a-c* on for example floor boards where the core material is made of a wood based material like fibre board, particle board, chip board, oriented strand board or massive wood. It is common knowledge among artisans that wood based materials will expand and contract depending on moisture content. This implies that a floor will be smaller in winter time when the moisture content in air at room temperature is lower than in late summer when the moisture content is high. This is observed by most people during the winter time when gaps often occur in wood flooring. The invention as described in connection to FIG. 4*a-c* will absorb this moisture propelled expansion and contraction. Typically around 1 mm per meter of floor will be more than enough to absorb. As one typical width of floor panels is 200 mm a sufficient movement allowed in a long side edge joint would be around ±0.1 mm. It is possible to use the joint described in FIG. 4*a-c* only on the long sides, the short sides or on all sides. It is also possible to use the herein described device on special places like doorways and the like or on every other or every third row of panels.

Referring now to FIG. 4*b* showing the assembled panels 1 from FIG. 4*a*. The joint is in a stretched state in FIG. 4*b*. This is the typical state the joint will be in during longer periods of very dry conditions. The flexible insert 27' is compressed while the polymer sealer 31 is slightly stretched.

Referring now to FIG. 4*c* showing the assembled panels 1 from FIG. 4*a*. The joint is in a compressed state in FIG. 4*c*. This is the typical state the joint will be in during longer periods of very humid conditions. The flexible insert 27[1] is unloaded while the polymer sealer 31 is compressed.

The joint shown in FIG. 4*a-c* will make normal dilation devices abundant and will make it possible to achieve door passages and very large surfaces without having to use any dilation devices.

The visible part of the polymer sealer can be dyed or lacquered to match the floor surface or to create any desired accent. It is also possible to provide it with a thin flexible foil or laminate provided with a printed decor. It is furthermore possible to provide the visible part of the polymer sealer with a printed decor directly on top of the visible surface. One known method for achieving this is the method of transfer printing. It is furthermore advantageous to at least blunt the edges of the upper surface closest to the polymer sealer.

It is also possible to provide the joint as shown in FIG. 3 with a flexible insert 27' to achieve flexibility in this joint as well. This flexible insert 31' is then suitably arranged on the mainly vertical upper cheek surfaces 22.

The invention is not limited by the embodiments shown since these can be varied in different ways within the scope of the invention.

The invention claimed is:

1. A panel comprising a rectangular oblong shape with at least a pair of long opposite edges and a pair of short opposite edges, wherein the pair of short opposite edges consists of a male edge and a female edge for bringing the panel and an adjacent similar panel in an assembled condition by joining the male edge of the panel by vertical assembly motion with the female edge of the adjacent similar panel, the male edge and the female edge comprising:

a first vertical assembly joining member on the male edge and a second vertical assembly joining member on the female edge, wherein the first vertical assembly joining member comprises an upper cheek with an inclined lower cheek surface located at the lower side of the upper cheek, the second vertical assembly joining member comprises a lower cheek with an inclined upper cheek surface located at the upper side of the lower cheek, and the inclined lower cheek surface interacts with the inclined upper cheek surface of the adjacent similar panel in the assembled condition by a direct contact between the cheek surfaces such that the panel and the adjacent similar panel are locked against each other in a horizontal direction;

the upper cheek and lower cheek, including the lower cheek surface and the upper cheek surface, being made in one piece from the same material as the actual panel;

locking surfaces intended to interact with each other as an automatic result of the vertical assembly motion and limiting vertical movement between the panel and the adjacent similar panel; and a polymer material situated on the female edge between an upper panel edge thereof and the lower cheek thereof;

wherein the pair of long opposite edges comprise a second male edge and a second female edge, comprising:

a tongue and a groove, wherein the groove is bordered by an upper lip and a lower lip which protrudes distally beyond the upper lip, wherein the groove cooperates with the tongue of an adjacent second similar panel in an assembled condition to limit vertical movement between the panel and the adjacent second similar panel, and wherein the upper lip and the lower lip are made in one piece from the same material; and at least a web and a depression, wherein the web cooperates with the depression of the adjacent second similar panel in an assembled condition, such that the panel and the adjacent second similar panel are locked against each other in a horizontal direction;

wherein the tongue and groove at the long edges are configured such that they allow assembling two of such panels to each other at these edges by an angling movement;

wherein the joining members at the short edges allow the joining at the short edges simultaneously with the angling movement at the long edges;

wherein the polymer material is present at the location of the joint of the short edges in the assembled condition of a plurality of such panels at their long and short edges;

wherein the polymer material comprises a portion that is present at the female edge at a location protruding distally from the corresponding upper panel edge;

wherein said polymer is arranged at a proximal side of the female edge of the pair of short opposite edges, such that, at said proximal side, there is mainly one protrusion formed; and wherein the inclined upper cheek surface is outwardly inclined in an upward direction.

2. The panel of claim 1, wherein the polymer material comprises a flexible insert located in a first recess.

3. The panel of claim 2, wherein the male edge further comprises a second recess leaving space for the flexible insert.

4. The panel of claim 3, wherein the flexible insert, the first recess, and the second recess allow a limited movement between two adjacent panels in the assembled condition.

5. The panel of claim 2, wherein the flexible insert is compressed in the assembled condition.

6. The panel of claim 1, wherein the portion of polymer material at a location protruding distally from the corresponding upper panel edge is formed as a protruding lip.

7. The panel of claim 1, wherein the locking surfaces are mainly horizontal.

8. The panel of claim 1, wherein the female edge and the male edge further comprise a male edge upper surface and a female edge upper surface, wherein the male edge upper surface and the female edge upper surface of the adjacent similar panel mate in the assembled condition.

9. The panel of claim 1, wherein the cheeks, inclusive of the cheek surfaces, are formed in the core material of the panel, and wherein the inclined lower cheek surface and the mainly vertical upper cheek surface lock against each other by the core material in a coupled condition of two of such panels.

10. The panel of claim 1, wherein the male and female edge allow for a limited movement of the panels towards each other or away from each other in the assembled condition.

11. The panel of claim 1, wherein cavities are present between the surfaces of the joint male edge and female edge in the assembled condition.

12. The panel of claim 1, wherein mating surfaces are present between the surfaces of the male edge and female edge of the joint and at least one of the mating surfaces contacts the polymer material in the assembled condition.

13. The panel of claim 1, wherein the panel comprises a core having an upper surface and a decorative surface layer atop the upper surface of the core, wherein the decorative surface layer covers the upper surface.

14. The panel of claim 1, wherein the polymer material is a thermoplastic material.

15. The panel of claim 1, wherein the polymer material is situated above an undercut.

16. The panel of claim 1, wherein the female edge comprises an inclined guiding surface which is positioned above the locking surfaces that limit the vertical movement in a coupled condition of two of such panels.

17. The panel of claim 1, wherein the short edges of the locking surfaces comprise a snapping hook and an undercut matching the snapping hook of an adjacent similar panel in the assembled condition.

18. The panel of claim 1, wherein the polymer is arranged at a proximal side of the female edge of the pair of short opposite edges, such that, in the assembled condition, it extends more inwardly with respect to the female edge than a protrusion present at a distal side of the male edge, said protrusion at the distal side of the male edge being made in one piece from the same material as the actual panel.

19. A panel comprising a rectangular oblong shape with at least a pair of long opposite edges and a pair of short opposite edges, wherein the pair of short opposite edges consists of a male edge and a female edge for bringing the panel and an adjacent similar panel in an assembled condition by joining the male edge of the panel by vertical assembly motion with the female edge of the adjacent similar panel, the male edge and the female edge comprising:

a first vertical assembly joining member on the male edge and a second vertical assembly joining member on the female edge, wherein the first vertical assembly joining member comprises an upper cheek with a lower cheek surface located at the lower side of the upper cheek, the second vertical assembly joining member comprises a lower cheek with an upper cheek surface located at the upper side of the lower cheek, and the lower cheek surface interacts with the upper cheek surface of the adjacent similar panel in the assembled condition by a direct contact between the cheek surfaces such that the panel and the adjacent similar panel are locked against each other in a horizontal direction;

the upper cheek and lower cheek, including the lower cheek surface and the upper cheek surface, being made in one piece from the same material as the actual panel;

locking surfaces intended to interact with each other as an automatic result of the vertical assembly motion and limiting vertical movement between the panel and the adjacent similar panel; and a polymer material situated on the female edge between an upper panel edge thereof and the lower cheek thereof;

wherein the pair of long opposite edges comprise a second male edge and a second female edge, comprising:

a tongue and a groove, wherein the groove is bordered by an upper lip and a lower lip which protrudes distally beyond the upper lip, wherein the groove cooperates with the tongue of an adjacent second similar panel in an assembled condition to limit vertical movement between the panel and the adjacent second similar panel, and wherein the upper lip and the lower lip are made in one piece from the same material; and at least a web and a depression, wherein the web cooperates with the depression of the adjacent second similar panel in an assembled condition, such that the panel and the adjacent second similar panel are locked against each other in a horizontal direction;

wherein the tongue and groove at the long edges are configured such that they allow assembling two of such panels to each other at these edges by an angling movement;

wherein the joining members at the short edges allow the joining at the short edges simultaneously with the angling movement at the long edges;

wherein the polymer material is present at the location of the joint short edges in the assembled condition of a plurality of such panels at their long and short edges;

wherein the polymer material comprises a portion that is present at the female edge at a location protruding distally from the corresponding upper panel edge;

wherein said polymer is arranged at a proximal side of the female edge of the pair of short opposite edges, such that, at said proximal side, there is mainly one protrusion formed; and wherein the upper cheek surface is outwardly inclined in an upward direction.

20. The panel of claim 19, wherein the polymer material comprises a flexible insert located in a first recess.

21. The panel of claim 20, wherein the male edge further comprises a second recess leaving space for the flexible insert.

22. The panel of claim 20, wherein the flexible insert is compressed in the assembled condition.

23. The panel of claim 19, wherein cavities are present between the surfaces of the joint male edge and female edge in the assembled condition.

24. The panel of claim 19, wherein the polymer is arranged at a proximal side of the female edge of the pair of short opposite edges, such that, in the assembled condition, it extends more inwardly with respect to the female edge than a protrusion present at a distal side of the male edge, said protrusion at the distal side of the male edge being made in one piece from the same material as the actual panel.

* * * * *